US007445089B2

(12) United States Patent
Kuipers et al.

(10) Patent No.: US 7,445,089 B2
(45) Date of Patent: Nov. 4, 2008

(54) SEALING DEVICE WITH MAGNETICALLY MOVABLE DOOR SEAL FOR A CLOSABLE DOOR LEAF OF AN ELEVATOR INSTALLATION

(75) Inventors: Erwin Reinder Kuipers, Udligenswil (CH); Peter A. Spiess, Meggen (CH)

(73) Assignee: Inventio AG, Hergiswil NW (CH)

( * ) Notice: Subject to any disclaimer, the term of this patent is extended or adjusted under 35 U.S.C. 154(b) by 350 days.

(21) Appl. No.: 10/939,580

(22) Filed: Sep. 13, 2004

(65) Prior Publication Data

US 2005/0087401 A1 Apr. 28, 2005

(30) Foreign Application Priority Data

Sep. 15, 2003 (EP) ..... 03405675

(51) Int. Cl.
*B66B 13/14* (2006.01)
*B66B 13/18* (2006.01)

(52) U.S. Cl. ..... 187/336; 187/335; 187/316

(58) Field of Classification Search ..... 187/335, 187/336, 313, 316, 330–331, 339, 340
See application file for complete search history.

(56) References Cited

U.S. PATENT DOCUMENTS

| | | | | |
|---|---|---|---|---|
| 1,344,430 | A * | 6/1920 | Wigmore et al. | 187/331 |
| 3,638,762 | A * | 2/1972 | Johns | 187/319 |
| 3,734,238 | A | 5/1973 | Secresty et al. | |
| 4,009,767 | A * | 3/1977 | Stadigh | 187/280 |
| 4,512,443 | A * | 4/1985 | Dewhurst | 187/314 |
| 4,735,293 | A | 4/1988 | Everhart et al. | |
| 5,114,195 | A * | 5/1992 | Martin et al. | 292/251.5 |
| 5,894,911 | A * | 4/1999 | Bozorgzadeh et al. | 187/335 |
| 6,945,363 | B2 * | 9/2005 | Angst et al. | 187/317 |
| 2004/0007429 | A1 * | 1/2004 | Angst et al. | 187/317 |
| 2005/0034931 | A1 * | 2/2005 | Deplazes et al. | 187/313 |
| 2006/0070820 | A1 * | 4/2006 | Hackl | 187/316 |
| 2006/0243534 | A1 * | 11/2006 | Miller et al. | 187/313 |
| 2007/0056807 | A1 * | 3/2007 | Spiess et al. | 187/336 |

FOREIGN PATENT DOCUMENTS

| | | |
|---|---|---|
| EP | 0 616 970 | 6/1997 |
| EP | 1 400 480 | 3/2004 |
| JP | 06171874 A * | 6/1994 |
| JP | 2001322786 | 11/2001 |

* cited by examiner

*Primary Examiner*—Walter Benson
*Assistant Examiner*—Eduardo Colon
(74) *Attorney, Agent, or Firm*—Fraser Clemens Martin & Miller LLC; William J. Clemens

(57) ABSTRACT

An elevator installation has a sealing element that is movable by an electromagnetic actuator from a first position to a second position. The sealing element includes a seal carrier that is movably arranged at a door leaf of a door of the elevator installation. An electromagnetic actuator is fastened in the region of the door and upon actuation acts on the seal carrier to move it from the first position to the second position. An electrical circuit triggers the actuation before the door leaf executes an opening movement.

21 Claims, 5 Drawing Sheets

SEALING DEVICE WITH MAGNETICALLY MOVABLE DOOR SEAL FOR A CLOSABLE DOOR LEAF OF AN ELEVATOR INSTALLATION

BACKGROUND OF THE INVENTION

The present invention relates to a device with a movable door seal for a closable door leaf of an elevator installation and an elevator installation with such a device.

Elevator installations usually comprise an elevator car that moves vertically upwardly and downwardly in an elevator shaft and can in general go to several floors. The elevator shaft has shaft doors with at least one horizontally displaceable shaft door leaf. A car door with at least one horizontally displaceable car door leaf is disposed at the elevator car. The car door moves in the shaft together with the elevator car. One of the shaft doors and the car door may open automatically only when on each occasion the elevator car reaches a destination floor. The shaft door of a floor is opened by the car door when the elevator car stops in the region of the corresponding floor. For the opening, the shaft door is moved by an entrainer unit of the car door, wherein the shaft door panel and the car door panel open virtually simultaneously.

Details of an entraining unit are shown in a patent application which was filed on Sep. 18, 2002 and bears the title "Coupling system for unlocking a shaft door leaf and a car door leaf". This patent application has application number EP 02405810.9.

Door gaps, which are usually sealed by sealing lips or the like, result between the car door leaves and the elevator car and in the region of the shaft door leaf. It is a disadvantage of these sealing lips that during opening and closing of the door leaf they rub along a sealing surface. Firstly this rubbing leads to wear of the sealing lips and secondly disturbing noises can be caused by the rubbing. Worn sealing lips no longer satisfactorily fulfil their sealing function. Disruptive air currents in the elevator car or in the shaft door region can thereby arise particularly in the case of high-performance elevators which move very rapidly. Moreover, disturbing noises can penetrate into the elevator car.

High pressure differences, which engage an intact sealing system, occur particularly in the case of high-performance elevators.

In the case of fire the passengers of the elevator can be put at risk by smoke gases. Accordingly, the door seals at the elevator car are to be designed so that they delay or even prevent penetration of combustion gases into the elevator car.

A sealing system for a car door is described in European Patent EP 616 970 B1 that shows an elevator car, the car door leaves of which are guided along a rail which has inclined sealing surfaces. Each car door leaf is provided with an angled profile member which has an inclined surface. If the car door leaves are closed, then the inclined surfaces of the angled profile members approach the inclined sealing surfaces. If the car door leaves are closed, the surfaces then lie on one another and serve as a seal. This arrangement is costly. Rubbing of the surfaces cannot be prevented by this solution.

Another kind of sealing system is shown in U.S. Pat. No. 4,059,191. In this patent an elevator installation is described which has a movable seal between the elevator car and the elevator shaft. Thus, on stopping of the elevator car at the level of the floor, disturbing air currents in the door region can be reduced. According to this patent a seal is pressed by the elevator car mechanically against the shaft wall on opening of the elevator doors.

A seal which can be moved electromagnetically is known from U.S. Pat. No. 3,734,238. However, this is a seal which provides a sealed region for the access to the elevator car. The point of this seal is to prevent disturbing noises or drafts from arising. After stopping of the elevator car in the region of the shaft door, seals are brought by stroke magnets into a setting for sealing off the transition region at the top, bottom and the sides. In other words, the seal permits a sealing between the elevator car and the elevator shaft. The seals do not seat at the doors.

A sealing system for sealing the elevator car is described in U.S. Pat. No. 4,735,293. This system is based on the fact that pressure seals are bought into a sealing position when the car door leaves close. For this purpose the car door leaves carry movable seals which during closing of the leaves run against a mechanical abutment and are thereby lowered into the sealing position. In that case a horizontal sliding movement of the car door leaves is converted into a vertical sliding movement of the seals. In this solution as well a rubbing movement between the seals and a sealing surface at the elevator car results during closing of the car door leaves.

The above-described solutions with movable seals are predominantly mechanical in nature. The construction is complex and heavy, which plays a role particularly in solutions in which the sealing device has to be accelerated and moved by the elevator car or the door panel. Completely slide-free seals cannot be realized by the described solutions or can be realized only with unjustifiably high cost.

A first solution which allows realization of completely slide-free seals is shown in the European patent application which was filed on Apr. 25, 2003 and bears the title "Device with movable door seal for a displaceable door leaf of an elevator installation, and elevator installation with such a device". This patent application has application number EP 03405293.6. The solution disclosed therein is based on a purely mechanical approach.

SUMMARY OF THE INVENTION

The present invention concerns a sealing device for an elevator installation for closing a sealing gap between a door leaf and an adjacent sealing surface. A sealing element is movably fastened to the door leaf of the elevator installation. An electromagnetic actuator is fastened to the door leaf and is adjacent to the sealing element. The electromagnetic actuator is actuatable for moving the sealing element from a first position (sealing) into a second position (open) when the electromagnetic actuator is actuated before or while the door leaf executes an opening movement.

It is therefore the object of the present invention to create an improved sealing system of the kind stated in the introduction, which avoids the disadvantages of the state of the art and allows a reliable sealing in the region of the shaft door or a reliable sealing of the elevator car in the region of the car door, wherein slide-free seals shall be used.

The following advantages are, in particular, achieved by the present invention:

The door seals can be moved away each time shortly before opening of the door leaves in order to completely prevent rubbing of the seals.

The seals can be better optimized since, depending on respective use, they are loaded, for example, only in pressure.

The seals can be so designed and arranged that they engage in a counter member in order to achieve an even better seal.

The elevator car can be screened off better and for a longer time against smoke and combustion gases.

The chimney effect of the elevator shaft can be reduced if the shaft doors are equipped with the sealing device according to the present invention.

Penetration of smoke and combustion gases into the shaft can be reduced if the shaft doors are equipped with the sealing device according to the present invention.

Disturbing noises (rattling noises of the sealing mechanism, rubbing noises of the seals) can be better suppressed or even prevented.

Through the lifting off or movement away of the seals the friction during opening and closing of the door leaves is reduced by comparison with doors with conventional seals. Lower forces are thus needed for opening and closing.

The sealing device according to the present invention is lighter than previous solutions. The masses to be accelerated and moved are thereby reduced.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1A:
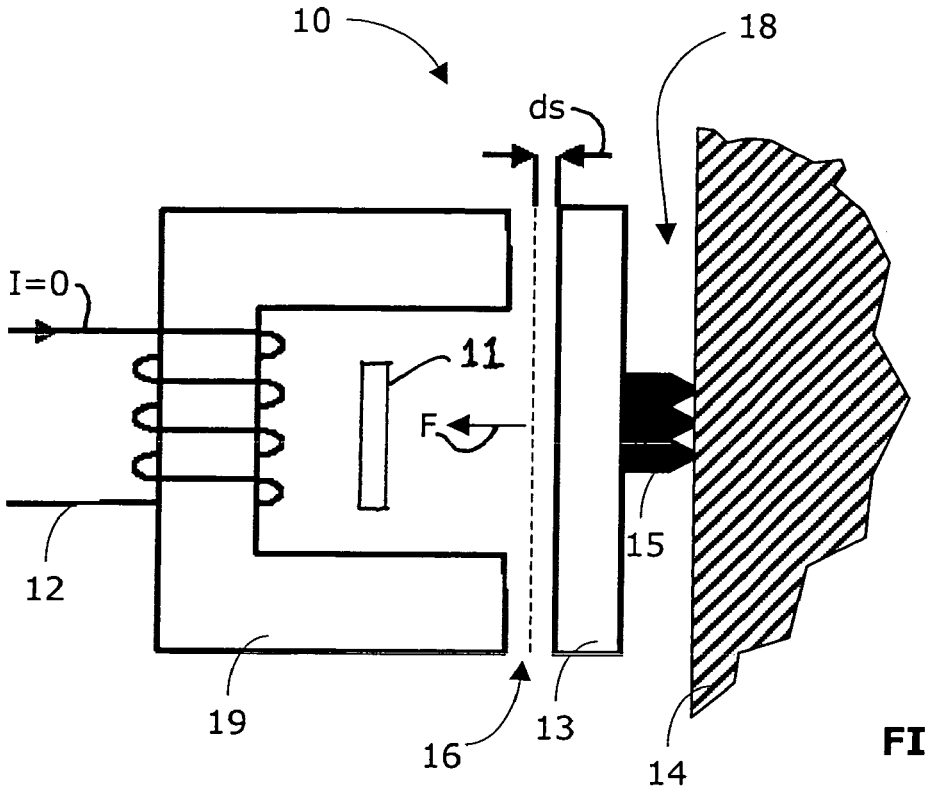
FIG. 1A is a schematic view of a first sealing device according to the present invention in a sealing position.

Like constructional elements or constructional elements acting in like manner are provided in the figures in part with the same reference numerals even when they are not identically constructed in detail. The figures are not to scale.

In connection with the present invention there is reference to an electromagnetic actuator. The term "electromagnetic actuator" is to be understood as a synonym for arrangements which comprise at least one excitation coil producing a magnetic flux in a (iron) core, often termed magnetic core, when a current "I" flows through the excitation core. The core is so designed that at least one working air gap results, which can be bridged over by an armature, in part also known as a yoke. The armature is so mounted and constructed that in the case of flow of current "I" in the excitation coil an electromagnetic flux runs through the core, working air gap and armature. Thus, a force is exerted on the armature and a movement of the armature is triggered.

Figure 1B:
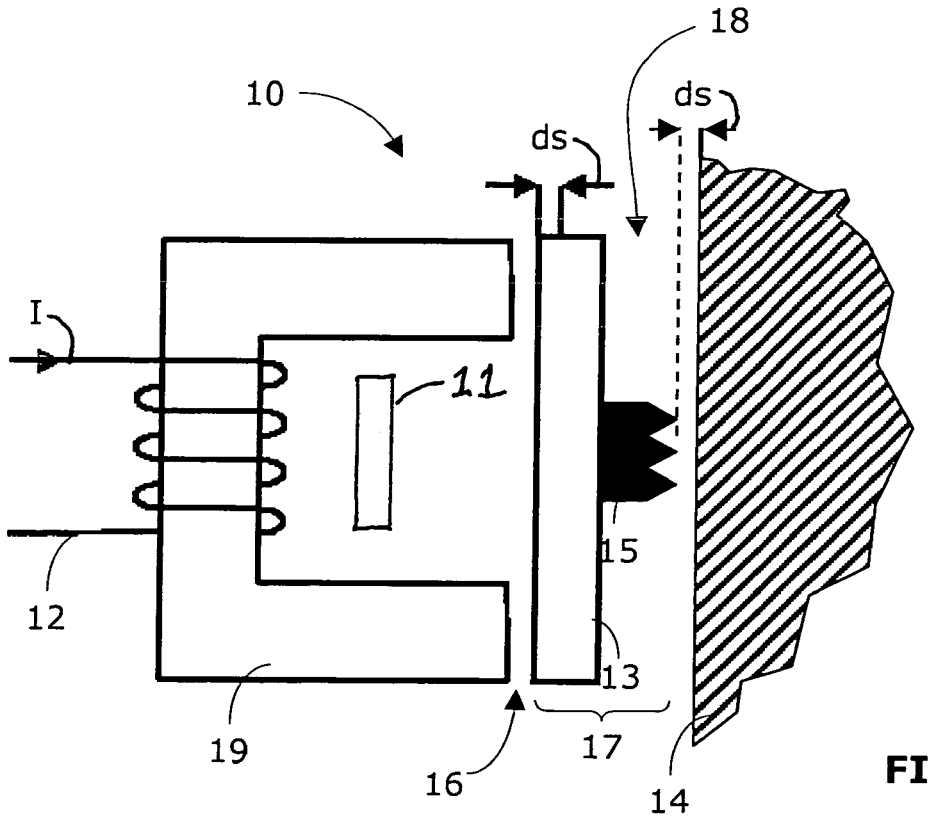
FIG. 1B is a schematic view showing the first sealing device of FIG. 1A in an open position.

FIGS. 1A and 1B show a first sealing device 10 according to the present invention in a schematic side view. The device 10 comprises a U-shaped (iron) core 19 extending through an excitation coil 12. An armature 13 is so arranged that it can be moved. In the illustrated example the armature 13 can execute a translational movement which is characterized by a distance ds. The armature 13 at the same time serves as a seal carrier for a sealing profile 15. The entire sealing device 10, which comprises the excitation coil 12 with the iron core 19, the sealing profile 15 and the armature 13 constructed as a seal carrier, is arranged on one side of a sealing gap 18. The sealing profile 15 is preferably a profile of resilient material. Moreover, a section through a sealing surface 14, which lies opposite, is shown. The armature 13 and the sealing profile 15 have a thickness 17 as seen in FIG. 1B.

The manner of functioning of the first scaling device 10 is as follows. If no current flows through the excitation coil 12, i.e. I=0, as shown in FIG. 1A, the armature 13 together with the sealing profile 15 is then disposed in a first setting which is also denoted herein as a sealing setting. In the sealing setting there results a sealing effect since the sealing profile 15 bears against the sealing surface 14. Springs (not shown) can be provided in order to produce a pressing force with respect to the sealing surface 14. It is also conceivable to mount the armature 13 in resilient manner or construct it as a spring, for example as a leaf spring. If a current is now supplied, i.e. I≠0, as shown in FIG. 1B, a magnetic field is then built up and the armature 13 is attracted by a force F. A working air gap 16 thereby reduces. In FIG. 1B there is shown a state in which the armature 13 was displaced to the left through the distance ds. This state is denoted as second setting or also as an open setting.

The device 10 is arranged at one of the doors of the elevator installation and allows the seal 15 to be brought out of the sealing setting into the open setting before or during movement of the corresponding door leaf. The seal 15 is thus a so-termed slide-free seal, since this is lifted off the sealing surface 14 before or while a movement of the door takes place.

Figure 2A:
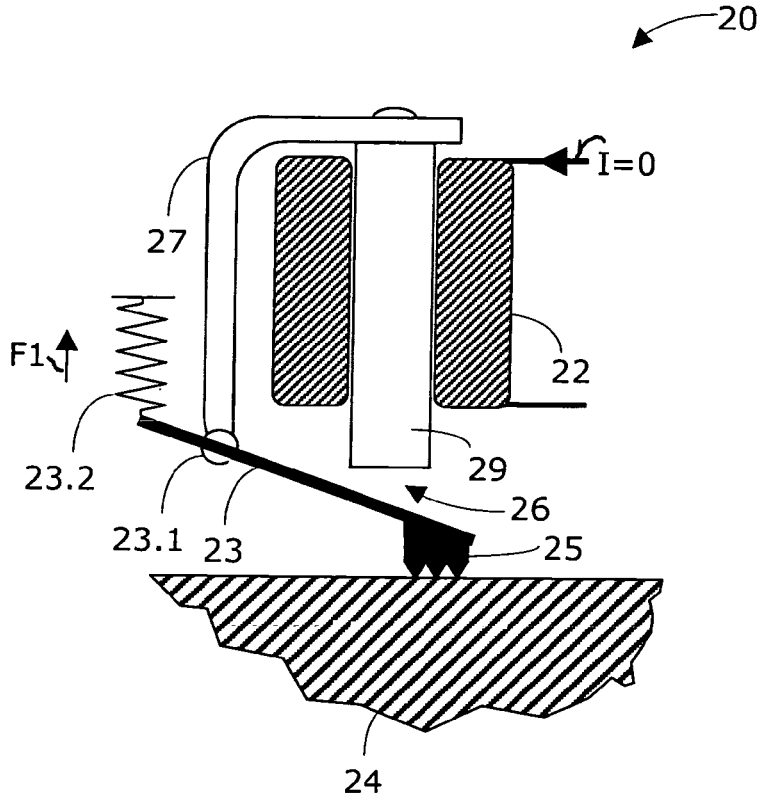
FIG. 2A is a schematic view of a second sealing device according to the present invention in a sealing position.
Figure 2B:
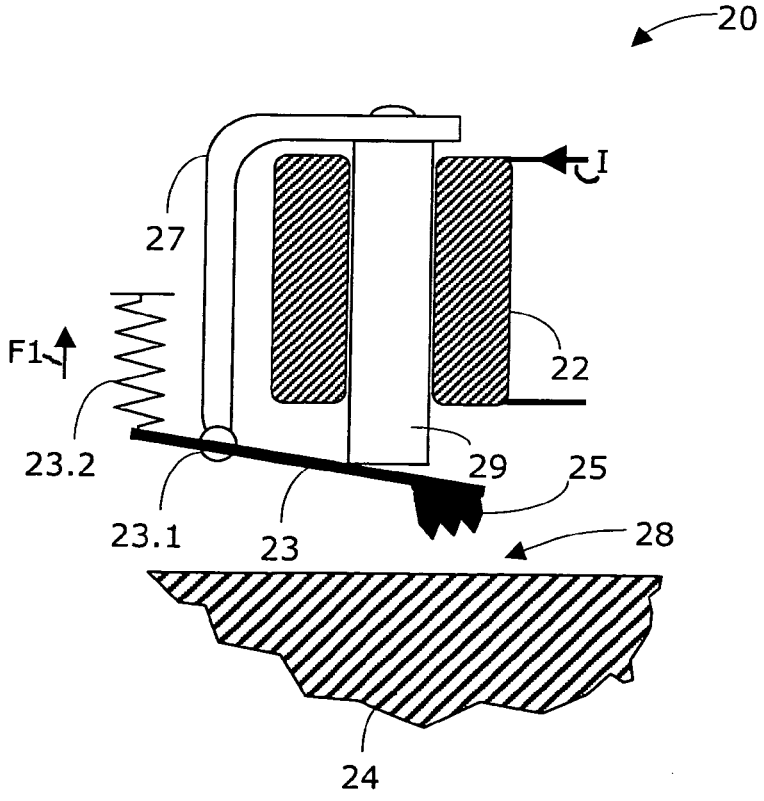
FIG. 2B is a schematic view of the second sealing device of FIG. 2A in an open position.

A particularly advantageous form of embodiment of the present invention is now described in conjunction with FIGS. 2A and 2B. It may be noted that there is concerned a schematic illustration in order to be able to better explain the working principle. A second sealing device 20 comprises a (iron) core 29 around which an excitation coil 22 is wound. A magnet bracket 27, which is magnetically conductively connected at the upper side with the core 29, is provided. An armature 23 is so arranged below the magnet bracket 27 and the core 29 that it can be moved. In the illustrated example the armature 23 can execute a pivot movement or rotational movement about a fulcrum 23.1. The armature 23 at the same time serves as a seal carrier for a sealing profile 25. The sealing profile 25 is preferably a profile of resilient material. Moreover, there is shown in the figures a section through a sealing surface 24 disposed opposite the sealing profile 25. The sealing surface 24 can be the floor or the door transom of an elevator car or the threshold of the shaft door. In this embodiment, as well, the entire sealing device 20, which comprises the excitation coil 22 with the iron core 29 and the armature 23—constructed as the seal carrier—with the seal 25, is arranged on one side of a sealing gap 28.

The manner of functioning of this schematic arrangement is as follows. If no current flows through the excitation coil 22, i.e. I=0, as shown in FIG. 2A, the seal carrier 23 inclusive of sealing profile 25 is then disposed in the sealing setting. In this sealing setting a sealing effect results, since the sealing profile 25 bears against the sealing surface 24. One or more springs 23.2 can be provided in order to produce a pressing force with respect to the sealing surface 24. The pressing force results from a spring force F1 and the lever arm, which the seal carrier 23 forms about the fulcrum 23.1. It is also conceivable to mount the seal carrier 23 in resilient manner or to construct it as a spring, for example as a leaf spring.

If now a current is imposed, i.e. I≠0, as shown in FIG. 2B, then a magnetic field is built up and the armature 23 attracted. A working air gap 26 thereby reduces. In FIG. 2B there is shown a state in which the seal carrier 23 was pivoted upwardly. This state is termed the open setting.

According to the present invention electrical means are provided in order to trigger actuation of the actuator before or while the door executes an opening movement. These electrical means are not shown in the schematic FIGS. 1A, 1B, 2A and 2B. It is a significant feature of the invention that the electrical means are connected with one of an elevator control of the elevator installation, a door entraining device which is disposed at the elevator car, a car door drive, and a lock or latch in the region of the car door of the elevator car in order to obtain from there an electrical signal which triggers the actuation. The electrical means are constructed to be autonomous, i.e. apart from a signal connection they need no further data connection or signal connection with other elements of the elevator installation. Preferably, the electrical means are connected with the current supply of the elevator car in order to be able to provide the current which is needed by the electromagnetic actuators. The electrical means move in company with the elevator car.

Figure 3:
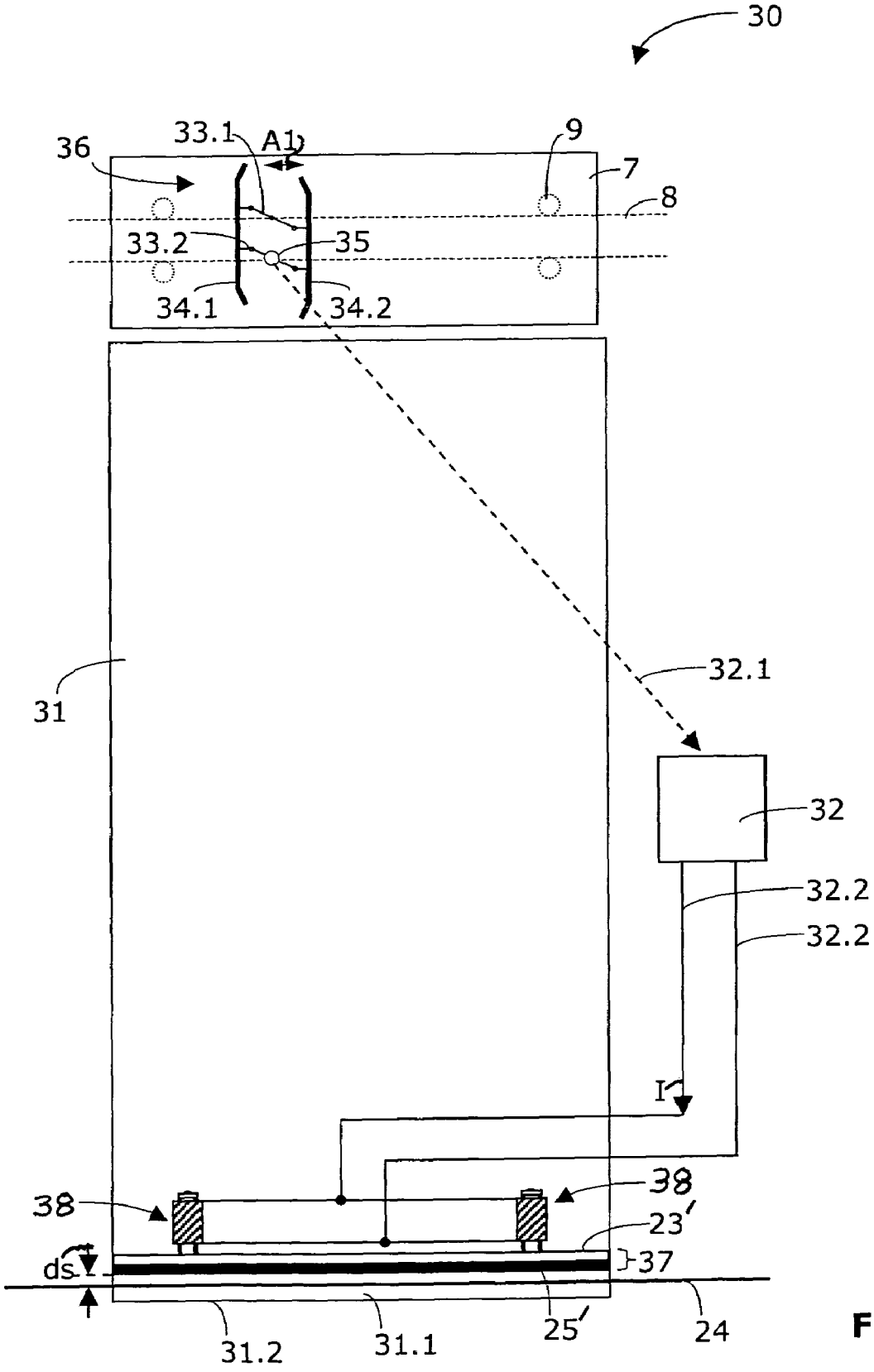
FIG. 3 is a schematic side elevation view of a car door leaf with a third sealing device according to the present invention.

A further embodiment of the sealing device is shown in FIG. 3. A sealing device 30 is based on an arrangement which is similar to the device shown in FIGS. 2A and 2B. A car door leaf 31 of an elevator installation is shown. The device 30 comprises a movable seal 37 that is carried by the horizontally displaceable door leaf 31. The device 30 is a component of an elevator car, which is part of the elevator installation with an elevator shaft and shaft doors. The door leaf 31 has in the upper region a schematically illustrated carriage which comprises a plate 7 with rollers 9. This carriage moves along a rail 8 which is mechanically fastened to the elevator car. This suspension enables a horizontal opening and closing movement of the car door leaf 31. A lower region 31.1 of the car door leaf 31 runs in a guide groove which is seated below the car floor sealing surface 24 indicated by a line. The seal 37 and electromagnetic actuators 38 are so arranged that the door leaf 31 in the closed state is sealed off at least in a region by the seal 37 with respect to the sealing surface 24 at the elevator car. The device 30 comprises an entrainer unit 36 which is fastened to the plate 7 of the door leaf 31. This entrainer unit 36 enables opening and closing of shaft door leaves in that it couples these with the car door leaf. The entrainer unit 36 comprises, for example, two runners 34.1 and 34.2 which extend parallel to one another and which are connected together by way of a lever system 33.1, 33.2. On stopping of the elevator car at the level of a floor and before opening of the door leaf 31 the entrainer unit 36 makes a first (spreading) movement. This movement is here termed part movement A1. The part movement A1 is produced by rotation of the lever of the lever system 33.1, 33.2 which is moved by a car door drive or a drive unit specially present for that purpose.

According to the present invention the device 30 comprises electrical circuit means 32, 32.1, 32.2 which are so electrically connected with the entrainer unit 36 that the part movement A1 has the effect that a current "I" is supplied to the excitation coils of the electromagnetic actuators 38. In the illustrated example the electrical means comprise a feeler, switch or sensor 35 which is arranged in the region of the entrainer unit 36 in order to detect the part movement A1 and transmit a signal to a control 32 by way of a connection 32.1. The control 32 can comprise, for example, a relay or other switching element and a current source in order to convert the signal into the current "I" which is supplied by way of the lines 32.2 to the excitation coils of the electromagnetic actuators 38. A seal carrier 23' and a sealing profile 25', herein termed the sealing element 37, execute a pivot motion as described in connection with FIG. 2B. This pivot motion takes place about an axis extending parallel to the lower edge 31.2 of the car door leaf 31.

It is ensured by the electrical means 35, 32, 32.1, 32.2 that the seal 37 is brought from a sealing position into an open position as soon as the entrainer unit 36 executes the part movement (A1). The transition to the open position takes place before or while the door leaf 31 is opened by a horizontal sliding movement.

Figures 4A, 4B, 4C:
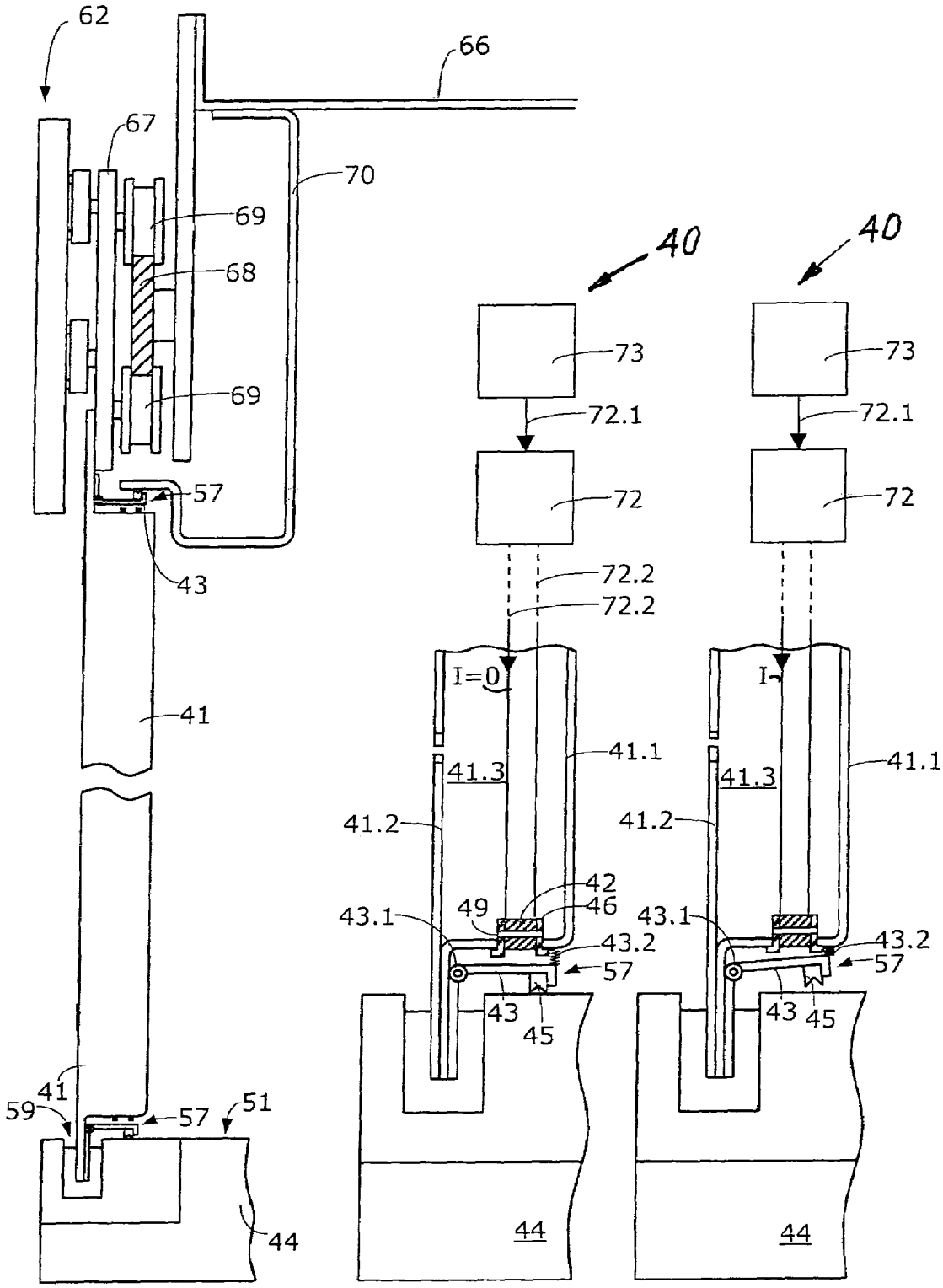
FIG. 4A is a schematic sectional view of a fourth sealing device with two movable seals, according to the present invention, wherein the seals are disposed in a sealing position.
FIG. 4B is an enlarged detail of the lower seal shown in FIG. 4A, wherein the seal is disposed in the sealing position.
FIG. 4C is an enlarged detail of the lower seal shown in FIG. 4A, wherein the seal is disposed in an open position.

A fourth embodiment of the present invention is shown in FIGS. 4A to 4C as a sealing device 40. Sections through a part of an elevator car 66 are shown in these figures. A car door leaf 41 can be recognized in FIG. 4A. The car door leaf 41 has a carriage which comprises a plate 67 with rollers 69. This carriage moves along a rail 68 which is mechanically fastened to the elevator car 66. This suspension enables a horizontal opening and closing movement of the car door leaf 41 in a plane perpendicular to the drawing plane. At the lower end the car door leaf 41 is guided in a recess 59 in a car floor 44. On the right-hand side of the car door leaf 41 (i.e. on the car inner side) a respective movable door seal 57 is arranged at the bottom and the top. The door seals 57 each comprise a seal carrier 43 and a sealing profile 45 and are connected with the car door leaf 41 by way of axles 43.1. The lower door seal 57 is so arranged, for example, that the car door leaf 41 in the closed state is sealed at least in a region by the door seal 57 with respect to a sealing surface 51.

The elevator car 66 comprises an entrainer unit 62 that is fastened to the plate 67 of the car door leaf 41. This entrainer unit 62 is used inter alia for opening shaft door leaves.

According to the present invention electromagnetic actuators are arranged in the lower and upper door region. These actuators are seated substantially within the door leaf 41 and are therefore recognizable in FIG. 4 only by schematic indication. Details of the illustrated form of embodiment can be inferred from FIGS. 4B and 4C which show a section through the lower region of the car door leaf 41 and the car floor 44. The car door leaf 41 comprises a screen 41.1 which is visible from the interior of the elevator car. A panel 41.2 is disposed on the side of the car door leaf 41 facing the elevator shaft. The screen 41.1 is bent over in the lower and upper region of the car door leaf 41 and thereby produces an inner space 41.3 in the car door leaf 41. In FIGS. 4B and 4C there can be recognized an actuator which comprises an excitation coil 42 wound around a core 49. The magnetic field lines run through a magnet bracket 46. An armature (the seal carrier) 43 is pivotably arranged below the actuator. The armature 43 is rotatable about the axle 43.1 and is disposed, in the sealing state, at a small spacing from the lower end of the magnet bracket 46. There thus exists in this state a working air gap between the magnet bracket 46 and the armature 43, i.e. the magnetic circuit embraces a working air gap. The armature 43 serves as the seal carrier for the sealing profile 45, which is preferably constructed to be resilient.

Electrical means 72, 72.1, 72.2 are present which in the illustrated example of embodiment are connected with a control 73 of the elevator installation. The control 73 gives the command for opening the car door leaf 41. At approximately this instant in time a signal is made available by way of the connection 72.1 to the circuit 72. Triggered by this signal, the circuit 72 supplies a current "I" through the lines 72.2 to the excitation coil 42. A magnetic field, which attracts the armature 43, is created by the current "I". The seal 57 is thereby transferred from the sealing position to the open position which is shown in FIG. 4C. A spring 43.2 can be provided which urges the seal carrier 43 together with the sealing profile 45 back into the sealing position.

A detail of the car door leaf 41 is shown in FIG. 4B, wherein the lower seal 57 is disposed in the sealing position. In FIG. 4C, thereagainst, the lower seal 57 is disposed in the open position. The sealing profile 45 is seated on the sealing surface 51, since the actuator does not exert any attracting force. If the actuator is now actuated, then the seal carrier 43 and the sealing profile 45 move upwardly, as indicated in FIG. 4C. In the open position there is no longer any contact between the sealing profile 45 and the sealing surface 51 at the car floor 44.

The electrical means 72, 72.1 and 72.2 as well as the actuator are preferably seated in the cavity 41.3 of the car door leaf 41. These means and also the actuator can also be differently arranged.

In the upper door region of the car door leaf 41 the seal 57 can be pressed against a door transom 70 or another sealing surface at the elevator car 66 (see FIG. 4A).

Figure 5:
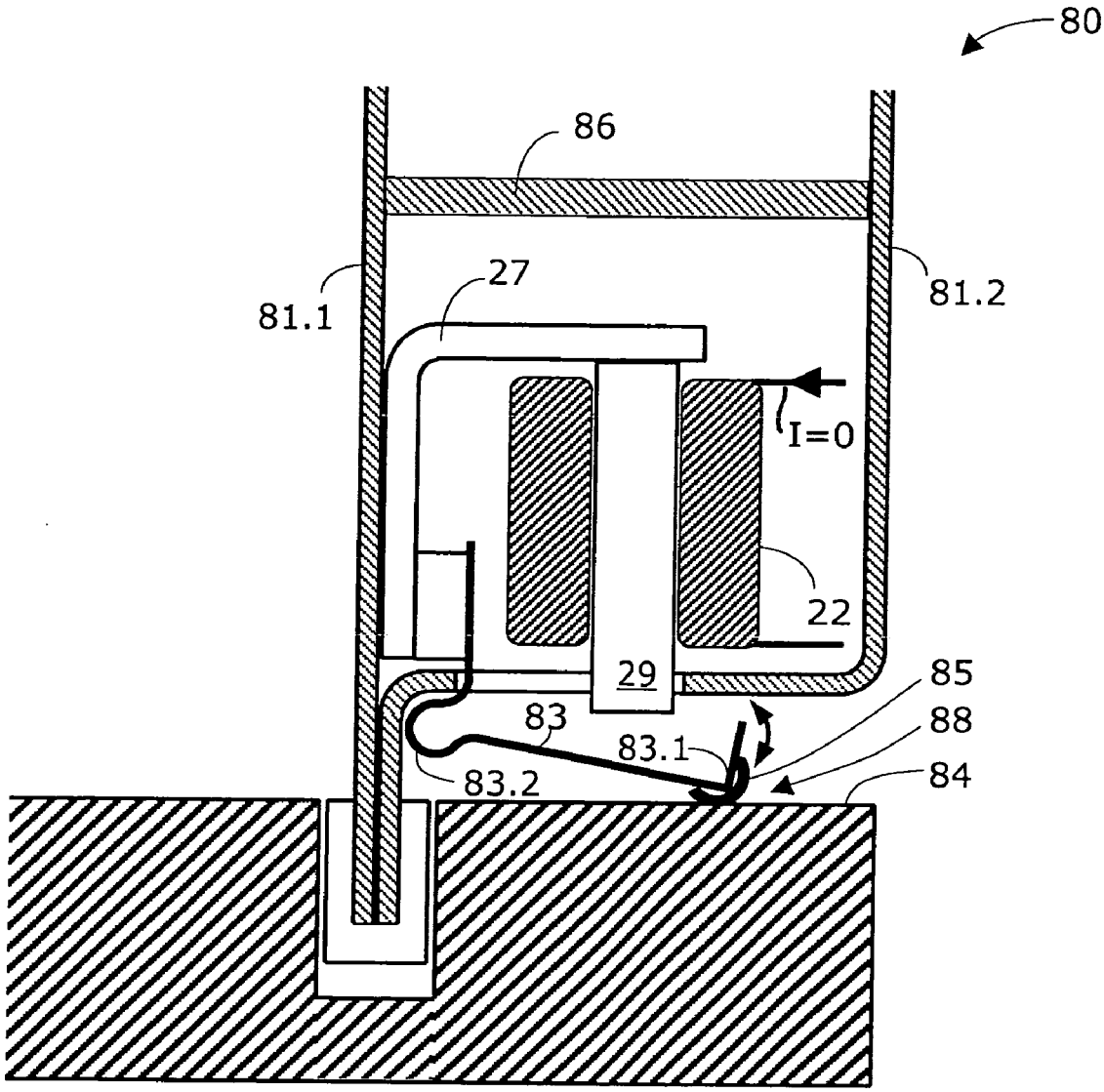
FIG. 5 is a schematic view of a fifth sealing device according to the present invention in a sealing position.

A fifth embodiment 80 of a sealing device according to the present invention in which the seal carrier itself is constructed to be at least partly resilient is particularly advantageous. A corresponding example is shown in FIG. 5. A seal carrier 83 is fastened in the region of a bent end region 83.2 to the magnet bracket 27 which is part of an actuator. The spring force of the resiliently designed seal carrier 83 should be so adjusted or designed that a sufficient pressing force of the seal carrier 83 with respect to a sealing surface 84 is achieved. The seal carrier 83 has a region 83.1 which carries a sealing profile 85. Through actuation of the actuators 22, 27, 29 the seal carrier 83 executes a pivot movement as indicated in FIG. 5 by the double arrow. It is also conceivable to provide the seal carrier 83 at least partly with a special layer, which preferably has resilient characteristics, instead of providing the separate sealing profile 85. In this form of embodiment as well the entire sealing device, which comprises the excitation coil 22 with the iron core 29 and the armature 83 constructed as a seal carrier, is arranged on one side of a sealing gap 88. In order to also seal off the cavity of the car door leaf against entry of air, a sheet metal strip 86 or another elongate sealing element can be arranged, for example, within the door leaf which, in the illustrated example, has a front wall plate 81.1 and a back wall plate 81.2.

In the case of further forms of embodiment of the sealing device similarly constructed seals with actuators are arranged at a shaft door leaf in order to achieve sealing of the shaft door leaf relative to at least one sealing surface which is arranged in the region of the shaft door frame or the shaft door threshold.

In a further form of embodiment the actuator additionally has one or more permanent magnets which are so arranged that a superimposition of permanently magnetic and electromagnetic flux arises in the working air gap. Through introduction of permanent magnets into the magnetic circuits of the actuator it can be achieved that the direction of the contact force is dependent on the flow direction of the excitation current "I". There is thus concerned a poled actuator. There is thereby achieved a superimposition of the electromagnetic excitation flux, which is produced by the excitation coil, and the permanent magnetic flux to form a total flux. A bistable electromagnetic actuator controlled by current pulses can thus be realized. The actuator can switch by current pulses with corresponding sign from one setting to the other setting. As shown in FIGS. 1A and 1B, a permanent magnet 11 can be added to form such an actuator.

According to the present invention the electromagnetic actuator provides either the closing force or the opening force or—in the case of bistable construction—the closing force and the opening force for the sealing device.

In FIGS. 1A to 4C there are described merely variants in which the opening force is provided by the actuator. Thus, a current must flow only as long as the seal is kept in the open position. It is usually sufficient to switch on the current only shortly before movement of the respective door and to maintain it during the movement.

The illustrated principle can be modified without further measures to exert a closing force on the seal. However, it is a disadvantage of this form of embodiment that in the sealing state, i.e. while the elevator car is disposed in travel, a current has to flow in order to keep the armature (seal carrier) in the sealing state.

The described embodiments can be modified in different mode and manner. Other embodiments can also be realized in which not only the car door leaf, but also the shaft door leaf are provided with removable seals.

Analogously to the illustrated embodiments a sealing device according to the present invention can also be arranged in the region of the shaft door in order to seal the shaft door leaf relative to a shaft door frame or a shaft door threshold.

For example, sealing devices according to the present invention can also be arranged at the vertical side edges of the car door leaf and/or shaft door leaf and/or the vertical door posts of the car doors and/or shaft doors.

In a further embodiment the electrical means are activated not from an entrainer unit, but they are directly or indirectly connected with the elevator control in order to be activated from there.

The seals can be so designed that they execute a translational, a rotational or a combined translational and rotational movement.

The seal carrier can be constructed as, for example, a pivoting element, a tipping element or a slide, for example a parallel guidance system.

The sealing profile can be optimized in correspondence with the respective application. For example, materials can be used which are usable for rubbing seals only with limitations or even not at all. Soft rubber mixtures, for example, are particularly suitable. It is also possible to admix magnetic particles with the material of the sealing profile. If a metal strip or the like is then brought against the opposing sealing surface, a magnetic attractive force then results between the sealing profile and the sealing surface. The sealing tightness can thereby be further improved.

Depending on the respective arrangement of the seals the interior space of the elevator car can be completed sealed off.

The part movement A1 of an entrainer element, which is used for controlling the opening movement of the seal or seals, can be, for example, the same movement which is used for unlocking the car door and/or the shaft door. As the part movement A1 there can also be applicable a setting movement which is executed in order to bring a runner unit of the car door into connection with shaft door rollers of a shaft door.

According to the present invention the device is mechanically connected with the door leaf and moves together therewith during opening and closing of the door leaf.

Preferably resetting elements are provided at the movable door seals in order to guide the seals by themselves back into the sealing position as soon as a force is no longer exerted on the seals by way of the actuators.

The present invention is particularly suitable for high-speed elevators and for elevators which have to be specially sealed.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A sealing device for an elevator installation for closing a sealing gap between a door leaf and an adjacent sealing surface of an elevator door comprising:

a sealing element movably fastened to the door leaf of the elevator door and positioned in the sealing gap; and an electromagnetic actuator being actuatable for moving said sealing element from a sealing position wherein said sealing element bears against the sealing surface into an open position wherein said sealing element is spaced from the sealing surface.

2. The sealing device according to claim 1 wherein said sealing element includes an armature, wherein upon actuation of said electromagnetic actuator a current flows through an excitation coil of said electromagnetic actuator to produce magnetic flux lines which exert a mechanical effect on said sealing element to move said sealing element from the sealing position into the open position.

3. The sealing device according to claim 1 wherein said sealing element and said electromagnetic actuator are fastened to the door leaf on one side of the sealing gap and said sealing element includes a seal carrier rotatable or pivotally mounted for movement from the sealing position into the open position.

4. The sealing device according to claim 1 wherein said sealing element includes a resilient sealing profile.

5. The sealing device according to claim 4 wherein said sealing element is at least partly resilient and said electromagnetic actuator exerts a mechanical force on said sealing clement which acts against a spring force of said sealing element.

6. The sealing device according to claim 1 wherein said electromagnetic actuator includes electrical means adapted to be connected with at least one of an elevator control, a door entraining device of an elevator car, a car door drive of an elevator car and a lock or latch of an elevator car for receiving an electrical signal which triggers the actuation of said electromagnetic actuator.

7. The sealing device according to claim 1 wherein said electromagnetic actuator includes at least one permanent magnet having magnetic field lines that are superimposed at least partly by electromagnetic field lines generated upon actuation of said electromagnetic actuator.

8. The sealing device according to claim 1 wherein said electromagnetic actuator is controlled so as to keep said sealing element distant from the sealing surface at least while the door leaf executes an opening or a closing movement.

9. The scaling device according to claim 1 wherein said electromagnetic actuator provides either a closing force or an opening force for the sealing device.

10. The sealing device according to claim 1 wherein an electromagnet and at least one permanent magnet are cooperating so as to form a bistable electromagnetic actuator controllable by pulses of different current direction.

11. The sealing device according to claim 1 wherein said sealing element is made from a resilient material including magnetic particles.

12. An elevator installation having a sealing device for sealing a door leaf of an elevator door to a scaling surface, the sealing device comprising:

a sealing element movably fastened to one of the door leaf and a door post;

an electromagnetic actuator fastened adjacent to said sealing element, said electromagnetic actuator acting on said sealing element to move said sealing element from a sealing position bearing against the sealing surface into an open position wherein said sealing element is spaced from the sealing surface; and means for triggering said electromagnetic actuator so that said sealing element is lifted off the sealing surface at least while the door leaf of the door executes an opening or closing movement.

13. The elevator installation according to claim 12 wherein said sealing element includes an armature, whereby upon actuation of said electromagnetic actuator a current flows through an excitation coil of said electromagnetic actuator to generate magnetic flux lines that exert a mechanical action on said sealing element.

14. The elevator installation according to claim 12 wherein said sealing element includes a seal carrier rotatable or pivotally mounted in a region of the door leaf of the elevator door.

15. The elevator installation according to claim 14 wherein said seal carrier includes a resilient sealing profile whereby when said seal carrier is disposed in the sealing position said seal carrier bears against and sealingly engages the sealing surface.

16. The elevator installation according to claim 15 wherein said sealing profile is made from a resilient material including magnetic particles.

17. The elevator installation according to claim 12 wherein the door leaf is a door leaf of an elevator car of the elevator installation that is sealed by said sealing device to the sealing surface, the sealing surface being disposed at one of a car floor, a transom region and a door post region of the elevator car.

18. The elevator installation according to claim 12 wherein the door leaf is a door leaf of a shaft door of the elevator installation that is sealed by said sealing device to the sealing surface, the sealing surface being disposed in one of a floor region, a transom region and a door post region at the shaft door of the elevator installation.

19. The elevator installation according to claim 12 wherein said electromagnetic actuator provides either a closing force or an opening force for the sealing device.

20. The elevator according to claim 12 wherein said electromagnetic actuator includes an electromagnet and at least one permanent magnet which cooperate so as to form a bistable electromagnetic actuator controllable by pulses of different current direction.

21. A sealing device for an elevator installation for closing a sealing gap between an edge of an elevator door leaf and an adjacent sealing surface comprising:

a sealing element pivotally fastened at the edge of the door leaf of the elevator door and positioned in the sealing gap, said sealing element extending a length of the edge of the door leaf; and an electromagnetic actuator being actuatable for pivoting said sealing element from a sealing position wherein said sealing element bears against the sealing surface into an open position wherein said sealing element is spaced from the sealing surface.

* * * * *